US006641442B1

(12) United States Patent
Seminara et al.

(10) Patent No.: US 6,641,442 B1
(45) Date of Patent: Nov. 4, 2003

(54) AIR BAG INITIATOR COAXIAL CONNECTOR

(75) Inventors: Phillip G. Seminara, Dearborn Heights, MI (US); William R. Lyons, Southfield, MI (US)

(73) Assignee: FCI Americas Technology, Inc., Reno, NV (US)

( * ) Notice: Subject to any disclaimer, the term of this patent is extended or adjusted under 35 U.S.C. 154(b) by 0 days.

(21) Appl. No.: 10/222,181

(22) Filed: Aug. 15, 2002

(51) Int. Cl.[7] ..... H01R 33/20
(52) U.S. Cl. ..... 439/675; 439/188; 439/101
(58) Field of Search ..... 439/101, 699.1, 439/839, 884, 886, 825, 833, 847, 848, 862, 188, 578, 675

(56) References Cited

U.S. PATENT DOCUMENTS 3,323,100 A * 5/1967 Book ..... 439/825
3,585,573 A * 6/1971 Robshaw ..... 439/887
4,973,257 A * 11/1990 Lhotak ..... 439/81
5,586,912 A 12/1996 Eslampour et al. ..... 439/620
5,688,141 A 11/1997 Dullin ..... 439/352
5,924,884 A 7/1999 Sato et al. ..... 439/336
5,944,545 A 8/1999 Willhelm et al. ..... 439/188
6,113,440 A * 9/2000 Fijten et al. ..... 439/862
6,167,808 B1 1/2001 Mramor ..... 102/202.9
6,203,342 B1 3/2001 Gauker et al. ..... 439/188
6,234,814 B1 5/2001 Hirschmann ..... 439/188

* cited by examiner

*Primary Examiner*—Tho D. Ta
(74) *Attorney, Agent, or Firm*—Harrington & Smith, LLP

(57) ABSTRACT

An electrical coaxial connector ground terminal comprising a first connection section and a second connection section. The first connection section is adapted for connecting the terminal to an electrical conductor. The second connection section is connected to the first connection section for removably electrically connecting the terminal to a mating terminal. The second connection section comprises a general C shaped section with protrusions spaced along an outer perimeter side of the general C shaped section. The protrusions form outwardly facing contact surfaces for the second connection section.

20 Claims, 2 Drawing Sheets

AIR BAG INITIATOR COAXIAL CONNECTOR

BACKGROUND OF THE INVENTION

1. Field of the Invention

The present invention relates to electrical connectors and, more particularly, to a coaxial electrical connector.

2. Brief Description of Prior Developments

U.S. Pat. No. 5,944,545 discloses a single pin coaxial initiator, retainer and connector. The connector has an arcuate contact piece for contacting the spring loaded arms of the conductive ring of the initiator.

Most commercial electrical connectors used for air bag gas generators are provided as two parallel contacts with at least one ferrite tube on a lead line to at least one of the contacts. Although this type of connector is good at preventing inadvertent discharge because of the provision of the ferrite member, there is a desire to reduce the size of electrical connectors for air bag gas generators. This is because newer vehicles will have a larger number of air bag gas generators, and some of these will be in areas of limited space, such as for a knee air bag, or a side air bag, or a seat belt pretensioner or air bag. Some will also have multi-stage gas generators and, thus, multiple initiators and multiple connectors for those initiators. There is a desire to make the electrical connectors smaller and more light weight, but without a significant increase in cost.

SUMMARY OF THE INVENTION

In accordance with one aspect of the present invention, an electrical coaxial connector ground terminal is provided comprising a first connection section and a second connection section. The first connection section is adapted for connecting the terminal to an electrical conductor. The second connection section is connected to the first connection section for removably electrically connecting the terminal to a mating terminal. The second connection section comprises a general C shaped section with protrusions spaced from each other along an outer perimeter side of the general C shaped section. The protrusions form outwardly facing contact surfaces for the second connection section.

In accordance with another aspect of the present invention, an air bag initiator coaxial connector is provided comprising a housing, a power terminal, a ground terminal, and a ferrite member. The power terminal is connected to the housing. The power terminal is adapted to receive a power contact pin of an air bag initiator. The ground terminal is connected to the housing. The ground terminal has a contact section located at least partially around the power terminal. The contact section of the ground terminal comprises a general C shaped profile and outwardly extending contact protrusions. The contact section comprises an outer diameter of about 5 mm or less.

In accordance with one method of the present invention, a method of assembling an electrical coaxial connector is provided comprising steps of providing a ground terminal with a contact section having a general C shape and outwardly extending contact protrusions; and snap-mounting the contact section to a ground terminal locating area of a connector housing. The contact section and the ground terminal locating area are sized and shaped with a gap at least partially therebetween and which allows the contact section to resiliently deflect inward towards the connector housing at the ground terminal locating area when the contact section is inserted into a mating member.

BRIEF DESCRIPTION OF THE DRAWINGS

The foregoing aspects and other features of the present invention are explained in the following description, taken in connection with the accompanying drawings, wherein.

DETAILED DESCRIPTION OF THE PREFERRED EMBODIMENT

Figure 1:
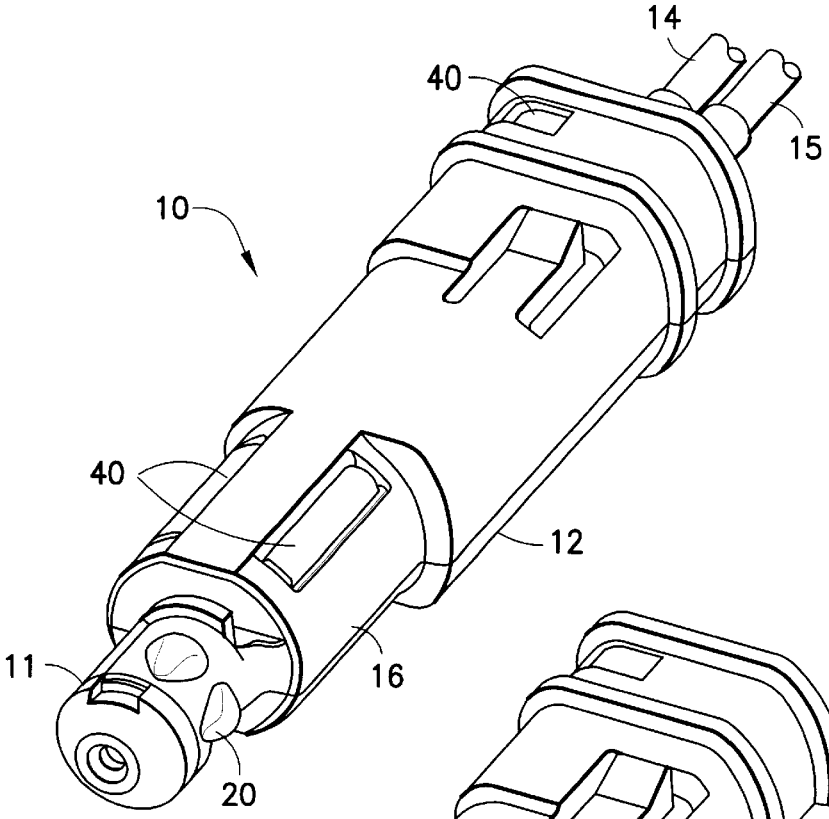
FIG. 1 is a perspective view of an end of an electrical connector and conductor assembly having an electrical connector incorporating features of the present invention.

Referring to FIG. 1, there is shown a perspective view of an electrical connector and conductor assembly 10 incorporating features of the present invention. Although the present invention will be described with reference to the exemplary embodiment shown in the drawings, it should be understood that the present invention can be embodied in many alternate forms of embodiments. In addition, any suitable size, shape or type of elements or materials could be used.

The assembly 10 is provided for connection to a gas generator (not shown), such as a micro gas generator used in a vehicle air bag assembly. However, the assembly 10 could be used to connect to any suitable type of electrical component. The assembly 10 generally comprises an electrical connector 12 and two electrical conductors 14, 15. In alternate embodiment, the assembly could comprise more than two electrical conductors, and/or the conductors could be provided in a cable configuration.

Figure 2:
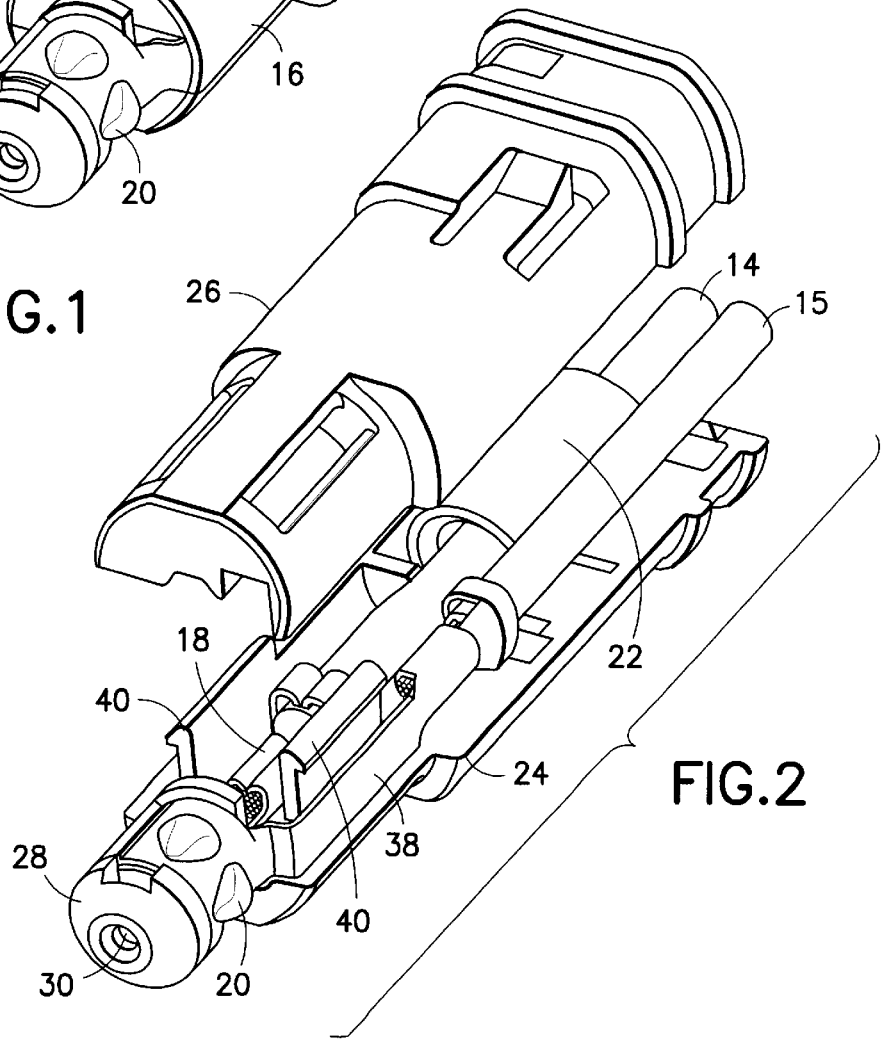
FIG. 2 is a partially exploded perspective view of the electrical connector shown in FIG. 1.

Referring also to FIG. 2, electrical connector 10 is provided as a coaxial electrical connector. The electrical connector 10 comprises a housing 16, a power terminal 18, a ground terminal 20 and a ferrite member 22. In an alternate embodiment, the electrical connector could comprise additional components. The connector 10 forms a mating connector insertion section 11 which is adapted to be inserted into a mating connector of a gas generator initiator.

The housing 16 comprises a first housing member 24 and a second housing member 26. The housing 16 forms a front insertion section 28. In the embodiment shown, the front insertion section 28 is provided on the first housing member 24. The front insertion section includes at a front aperture 30 therethrough. The front insertion section 28 also comprises a general annular or C shaped groove portion 32 (see FIG. 4) on its exterior side. The two housing members 24, 26 are adapted to be snap lock mounted to each other by snap-lock mounting sections 40. When the two housing members 24, 26 are snap lock mounted to each other they capture portions of the terminals 18, 20, ferrite member 22, and conductors 14, 15 therebetween.

Figures 3, 4:
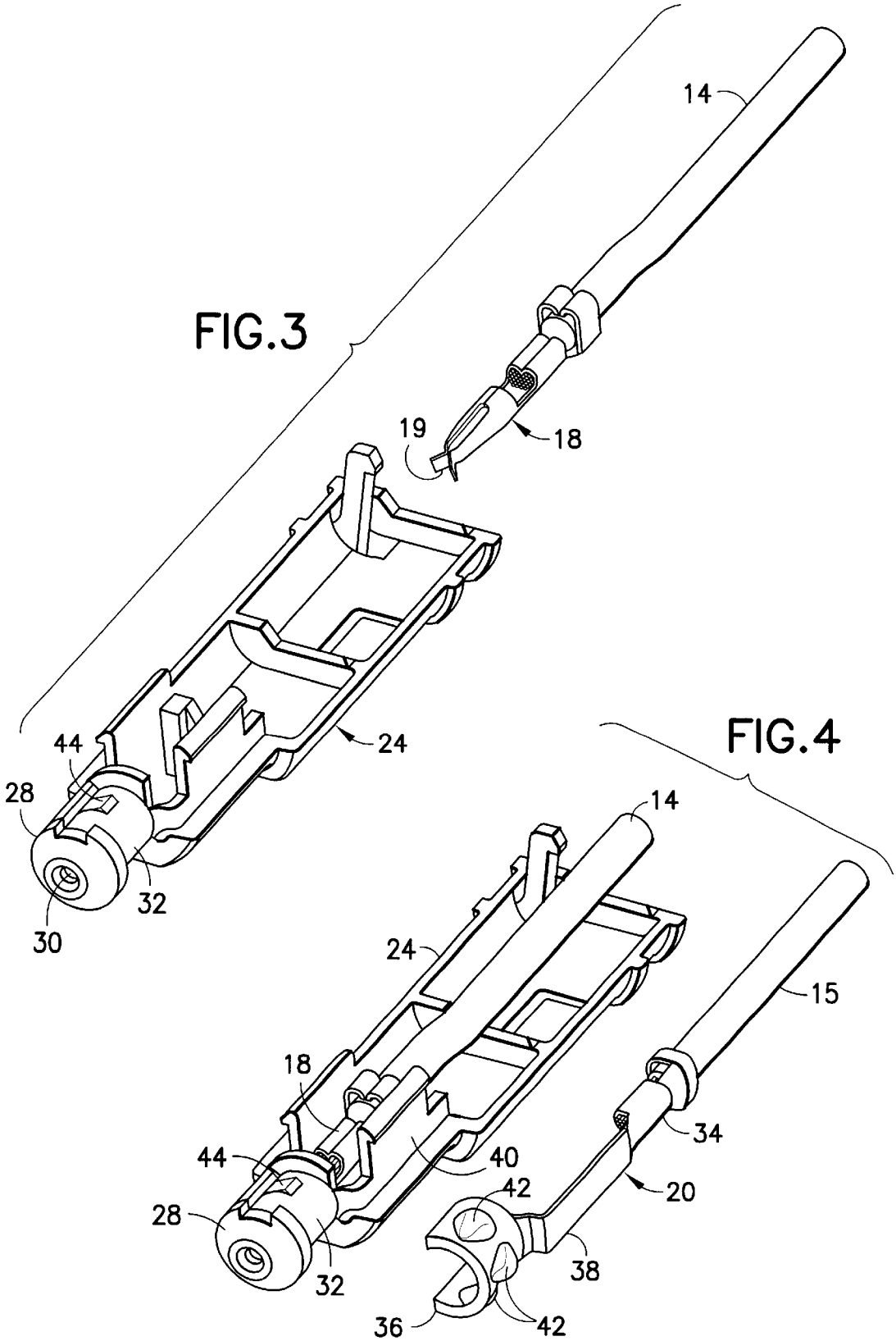
FIG. 3 is an exploded perspective view of the first housing piece and the power contact and cable assembly of the connector shown in FIG. 2.
FIG. 4 is an exploded perspective view of the first housing piece, the power contact in cable assembly, and the ground contact and cable assembly of the connector shown in FIG. 2.

Referring also to FIG. 3, the power terminal 18 is provided as a female contact. The terminal 18 is electrically and mechanically connected to the first electrical conductor 14. The terminal 18 is inserted into the first housing member 24 such that the front entrance aperture 19 of the terminal 18 is located behind and aligned with the aperture 30 of the front insertion section 28. Any suitable type of female terminal could be used.

As seen in FIG. 2, the ferrite member 22 is provided as a tubular ferrule which is located over a portion of the conductor 14. As is known in the art, the ferrite member 22 is provided to prevent an unintentional electrical signal being transmitted by the electrical conductor 14 to the power terminal 18. Any suitable type of ferrite member could be provided.

Referring also to FIG. 4, the ground terminal 20 generally comprises a one-piece member. Contact portions of the ground terminal 20 could be plated with a suitable plating material. The one-piece member is preferably formed from sheet metal which has been stamped and formed into the shaped shown. The ground terminal 20 generally comprises a first connection section 34 and a second connection section 36. The first connection section 34 is provided for connecting the terminal to the second electrical conductor 15. In the embodiment shown, the first connection section 34 is adapted to be compressed or crimped onto the conductor 15. However, any suitable type of connection between the terminal and the electrical conductor 15 could be provided.

The second connection section 36 is connected to the first connection section 34 by a bridging section 38. The bridging section 38 is contoured to be positioned on an outer side of one of the pair of forward snap lock mounting sections 40 of the first housing member 24. The power terminal 18 can be located between the pair of forward mounting sections 40. Thus, the mounting section 40 can be used to provide an insulation barrier between the terminals 18, 20. More importantly, one of the mounting sections 40 provides a structural support for the inside surface of the bridging section 38.

The second connection section 36 comprises a general C shaped profile or cross-section. The second connection section 36 includes an outwardly extending protrusions 42. In the embodiment shown, the second connection section 36 comprises three of the protrusions 42. In an alternate embodiment, more or less than three protrusions could be provided. The protrusions 42 are spaced from each other along the outer side of the second connection section 36 with one of the protrusions being located on a top side, another one of the protrusions being located on a bottom side, and a third one of the protrusions being located on a lateral side. The protrusions extend radially outward relative to a center axis of the general C shaped section.

In the embodiment shown, the protrusions 42 comprise a general rounded hill shape. However, in alternate embodiments, the protrusions 42 could comprise any suitable type of shape. For example, the front facing sides of the hill shapes could comprise elongated slopes to help with insertion of the front end of the connector 12 into an initiator. In order to form the protrusions 42 the sheet metal material of the second connection section 36 is stamped in an outward direction to form outward deformations of the sheet metal. Thus, recesses are formed under the outwardly extending hill shapes. As seen in FIGS. 1 and 2, after the second connection section 36 is mounted to the housing 16, the second connection section has its outer side freely exposed. Because it is a ground contact, the contact 20 does not need to be covered by the housing 16 and the mating connector of the gas generator initiator can cover the second connection section 36 when it is inserted into the mating connector of the gas generator initiator.

The natural shape of the second connection section 36 is preferably sized and shaped to be snap lock mounted into the groove portion 32 of the front insertion section 28. In a preferred embodiment the outer diameter of the second connection section 36 is about 5 mm or less. In an alternate embodiment the size of the outer diameter could be larger than 5 mm. However, the inner diameter of the second connection section 36 is preferably slightly larger than the outer diameter of the groove portion 32 such that a gap is formed therebetween. This allows the second connection section 36 to be able to move relative to the front insertion section 28 inside the groove portion 32. More specifically, the second connection section 36 is adapted to the compressed in an inward direction inside the groove portion 32 and, thus, is adapted to reduce the inner diameter of the second connection section 36. This feature allows the second connection section 36 to be slightly compressed when the front end of the connector 12 is inserted into a gas generator initiator. This allows the second connection section 36 to form a better electrical connection with the mating connector contact in the gas generator initiator. The ability of the second connection section 36 to deflect inwardly also helps to prevent damage to the ground contact in the mating electrical connector.

The coaxial nature of the connector also helps to reduce the size of the connector. The connector can be used with a mating connector which comprises only a single pin rather than a conventional double parallel pin air bag connector. Thus, the single pin design feature of the present invention can allow for a smaller packaging size for the connector.

In the embodiment shown, the front insertions section 28 of the housing includes at least one locating projection 44. The locating projection 44 is located in the groove portion 32 and extends in an outward direction. The locating projection is aligned with one of the protrusions 42 of the second connection section 36. Because of the hollow area under the protrusions 42, the locating projections can fit inside the hollow area(s) and help to retain the second connection section mounted to the front insertion section 28; even thought the second connection section is movably mounted on the front insertion section 28. This type of additional mounting retainer helps to prevent over-stressing the second connection section 36 during snap-lock mounting; especially in view of the relatively small size of the second connection section (preferably 5 mm diameter or less). In an alternate embodiment, the locating projection(s) 44 might not be provided.

One of the features of the present invention is the reduced cost to manufacture and assemble a connector incorporation features of the present invention. In particular, the two piece construction of the housing, the relatively simple snap lock mounting of the ground contact to the housing, and the relatively simple placement of the power contact in the housing all combine to reduce the manufacturing and assembly cost of the connector.

Another feature of the present invention is in regard to the size of the front end of the connector 12. Conventional connectors for air bag gas generator initiators have a initiator insertion portion size of about 11 mm or more. With the present invention this size is reduced more than 50 percent. This reduced size feature can be provided because of the unique design. The second connection section of the ground contact is substantially freely exposed at its outer side so, with no housing covering the outer side of the second connection section of the ground contact, the front connector insertion portion can be smaller than in the prior art. However, the housing still insulates the power contact from the ground contact. In addition, the design allows the second connection section of the ground contact to still be movable to allow a resilient connection with the mating connector of the gas generator initiator. This movablility or play in the second connection section 36 prevents damage to the ground contact of the mating connector.

The front end of the front insertion section 28 is also shaped to provide a camming feature for when the front end of the connector is inserted into the mating connector of the gas generator initiator. Thus, even thought the height of the protrusions 42 might be relatively small, the ground contact of the mating connector can still be resiliently deflected with a spring force during insertion to provide a strong contact force against the protrusions 42. It has been found that a connector incorporating features of the present invention can provide sufficient contact surface area and contact normal force at the protrusions 42 to meet current U.S. car initiator standards.

In a preferred embodiment the second connection section 36 has three of the protrusions. The third lateral protrusion has been found to prevent the top and bottom protrusions 42 from directly fighting each other and preventing inserting into the mating connector. Instead, the third lateral protrusion causes the top and bottom protrusions to shift in a direction to one side during compression, closing around the front insertion section and thereby preventing insertion problems into the mating connector of the initiator.

In alternate embodiments the connector could comprise any suitable type of connector housing or housing pieces.

The housing pieces could be connected to each other in any suitable fashion. In another alternate embodiment the mounting of the second connection section to the housing could comprise additional or alternative mounting features, but the connection preferably provides a movable (compressible) mounting of the ground contact to the housing at its point of intended connection with the gas generator initiator.

It should be understood that the foregoing description is only illustrative of the invention. Various alternatives and modifications can be devised by those skilled in the art without departing from the invention. Accordingly, the present invention is intended to embrace all such alternatives, modifications and variances which fall within the scope of the appended claims.

What is claimed is:

1. An electrical coaxial connector ground terminal comprising:

a first connection section for connecting the electrical coaxial connector ground terminal to an electrical conductor; and a second connection section connected to the first connection section for removably electrically connecting the electrical coaxial connector ground terminal to a mating terminal, the second connection section comprising a general C shaped section with protrusions spaced along an outer perimeter side of the general C shaped section, the protrusions forming outwardly facing contact surfaces for the second connection section;

wherein the general C shaped section has an inner perimeter side for mounting on a connector housing.

2. An electrical coaxial connector as in claim 1 wherein the second connection section comprises at least three of the protrusions spaced from each other.

3. An electrical coaxial connector as in claim 1 wherein the protrusions each comprise a generally rounded hill shape.

4. An electrical coaxial connector as in claim 1 wherein the protrusions extend radially outward relative to a center axis of the general C shaped section.

5. An electrical coaxial connector as in claim 1 wherein the terminal is comprised of sheet metal and wherein the protrusions comprise outward deformations of the sheet metal.

6. An electrical coaxial connector as in claim 1 wherein the second connection section comprises an outer diameter of about 5 mm or less.

7. An air bag initiator coaxial connector comprising:

a housing;

a power terminal connected to the housing, the power terminal being adapted to receive a power contact pin of an air bag initiator;

a ground terminal as in claim 1 connected to the housing, the second connection section being located at least partially around the power terminal; and a ferrite member connected to the housing.

8. An air bag initiator coaxial connector as in claim 7 wherein the second connection section is suitably sized relative to the general annular groove portion of the front insertion section such that the general C shape of the second connection section can close around the front insertion section thereby reducing its outer diameter.

9. An air bag initiator coaxial connector as in claim 7 wherein the housing comprises a front insertion section adapted to be inserted into a mating member, wherein a portion of the power terminal is located in the front insertion section aligned with a front aperture in the front insertion section, and wherein the second connection section is mounted over a general annular groove portion of the front insertion section.

10. An air bag initiator coaxial connector as in claim 9 wherein an exterior side of the second connection section is freely exposed at the front insertion section.

11. An air bag initiator coaxial connector comprising:

a housing;

a power terminal connected to the housing, the power terminal being adapted to receive a power contact pin of an air bag initiator;

a ground terminal connected to the housing, the ground terminal having a contact section located at least partially around the power terminal; and a ferrite member connected to the housing, wherein the contact section of the ground terminal comprises a general C shaped profile and outwardly extending contact protrusions and, wherein the contact section comprises an outer diameter of about 5 mm or less.

12. An air bag initiator coaxial connector as in claim 11 wherein the contact section comprises three of the protrusions spaced from each other.

13. An air bag initiator coaxial connector as in claim 11 wherein the protrusions each comprise a generally rounded hill shape.

14. An air bag initiator coaxial connector as in claim 11 wherein the protrusions extend radially outward relative to a center axis of the general C shaped contact section.

15. An air bag initiator coaxial connector as in claim 11 wherein the ground terminal is comprised of sheet metal and wherein the protrusions comprise outward deformations of the sheet metal.

16. An air bag initiator coaxial connector as in claim 11 wherein the housing comprises a front insertion section adapted to be inserted into a mating member, wherein a portion of the power terminal is located in the front insertion section aligned with a front aperture in the front insertion section, and wherein the contact section of the ground terminal is mounted over a general annular groove portion of the front insertion section.

17. An air bag initiator coaxial connector as in claim 16 wherein an exterior side of the contact section of the ground terminal is freely exposed at the front insertion section.

18. An air bag initiator coaxial connector as in claim 17 wherein the contact section of the ground terminal is suitably sized relative to the general annular groove portion of the front insertion section such that the general C shape of the contact section can close around the front insertion section thereby reducing its outer diameter.

19. A method of assembling an electrical coaxial connector comprising steps of:

providing a ground terminal with a contact section having a general C shape and outwardly extending contact protrusions; and snap-mounting the contact section to a ground terminal locating area of a connector housing, wherein the contact section and the ground terminal locating area are sized and shaped with a gap at least partially therebetween and which allows the contact section to resiliently deflect inward towards the connector housing at the ground terminal locating area when the contact section is inserted into a mating member.

20. A method as in claim 19 wherein the step of snap-mounting comprises the contact section having a general C shaped profile, and the contact section expands to snap over the ground terminal locating area.

* * * * *